United States Patent [19]

Stine

[11] 4,448,251

[45] May 15, 1984

[54] IN SITU CONVERSION OF HYDROCARBONACEOUS OIL

[75] Inventor: Laurence O. Stine, Western Springs, Ill.

[73] Assignee: UOP Inc., Des Plaines, Ill.

[21] Appl. No.: 448,117

[22] Filed: Dec. 9, 1982

Related U.S. Application Data

[63] Continuation-in-part of Ser. No. 223,467, Jan. 8, 1981, abandoned.

[51] Int. Cl.[3] ..... E21B 43/24; E21B 43/40

[52] U.S. Cl. ..... 166/263; 166/261; 166/267; 166/302; 166/303

[58] Field of Search ..... 166/258, 261, 263, 266, 166/267, 302, 303, 305 R

[56] References Cited

U.S. PATENT DOCUMENTS

| | | | |
|---|---|---|---|
| 3,084,919 | 4/1963 | Slater | 166/261 X |
| 3,139,928 | 7/1964 | Broussard | 166/261 |
| 3,515,213 | 6/1970 | Prats | 166/303 X |
| 3,598,182 | 8/1971 | Justheim | 166/247 |
| 3,617,471 | 11/1971 | Schlinger et al. | 166/266 X |
| 3,973,628 | 8/1976 | Colgate | 166/303 X |
| 4,050,515 | 9/1977 | Hamrick et al. | 166/303 |
| 4,127,171 | 11/1978 | Allen | 166/261 X |

*Primary Examiner*—George A. Suchfield

*Attorney, Agent, or Firm*—James R. Hoatson, Jr.; John G. Cutts, Jr.; William H. Page, II

[57] ABSTRACT

A method for the in situ conversion and recovery of heavy hydrocarbonaceous crude oil containing indigenous trace metal from two adjacent non-communicating hydrocarbon reservoirs which are alternately pressured and recovered which method comprises: (a) heating the heavy hydrocarbonaceous crude oil in a first reservoir to a hydrocarbon conversion temperature; (b) contacting the first reservoir with elemental essentially-anhydrous hydrogen at a pressure from about 200 to about 10,000 psig; (c) heating the heavy hydrocarbonaceous crude oil in a second reservoir to a hydrocarbon conversion temperature; (d) depressuring the first reservoir to yield an effluent comprising hydrocarbonaceous crude oil and unreacted elemental hydrogen; (e) separating the effluent from the first reservoir to recover a hydrocarbonaceous crude oil and a gaseous component comprising elemental hydrogen; (f) contacting the second reservoir with elemental essentially-anhydrous hydrogen, a portion of which is recovered in step (e), at a pressure from about 200 to about 10,000 psig; and (g) depressuring said second reservoir to yield an effluent comprising hydrocarbonaceous crude oil and unreacted elemental hydrogen.

7 Claims, 1 Drawing Figure

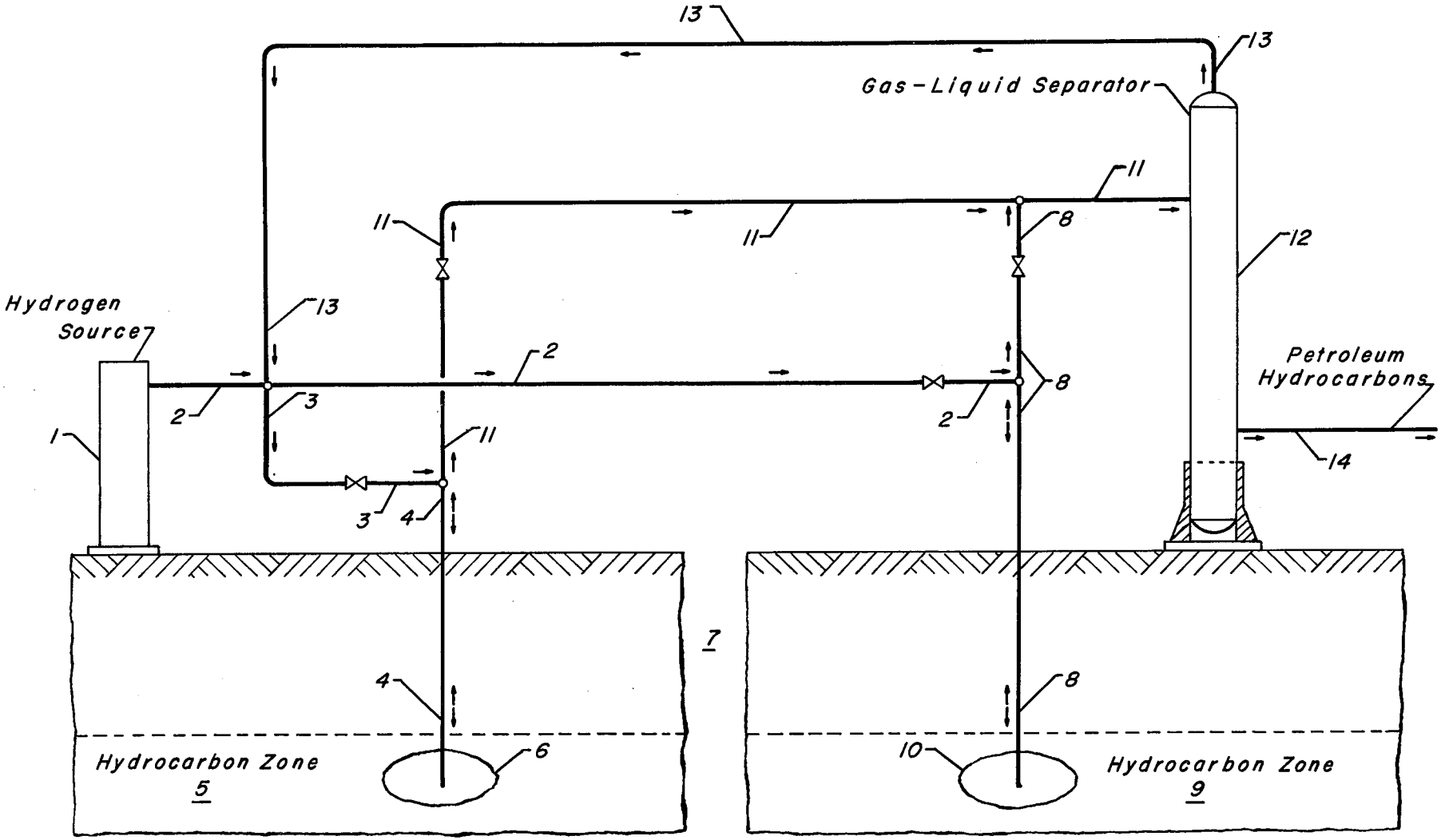
Petroleum Hydrocarbons
14
12
13
Gas-Liquid Separator
11
8
8
8
2
10
Hydrocarbon Zone
9
13
11
7
2
11
6
11
4
3
4
13
3
2
Hydrogen Source
1
Hydrocarbon Zone
5

IN SITU CONVERSION OF HYDROCARBONACEOUS OIL

CROSS REFERENCE TO RELATED APPLICATION

This application is a continuation-in-part of my copending U.S. application Ser. No. 223,467 which, now abandoned, was filed on Jan. 8, 1981 and which application is incorporated herein by reference.

BACKGROUND OF THE INVENTION

The present invention is directed toward the in situ conversion and subsequent recovery of heavy hydrocarbonaceous crude oil. Although conventional crudes may be recovered by pumping and subsequent enhanced oil recovery procedures, the heavier crude oils which have been discovered resist the heretofore conventional techniques utilized for recovery. In any case, the recovery of crude oil is never complete and the utilization of conventional techniques for heavy crude recovery is even more bleak. For example, some of the heaviest crude oil deposits have a conventional recovery rate of approximately 5 percent. Moreover, such a heavy oil requires substantial processing in order to yield useful products.

Therefore, in order to recover greater quantities of the heavier crude oil, I propose to convert these crudes in situ with a combination of high temperature and high pressure hydrogen and to recover lighter and therefore more easily recoverable crude oil. In addition, many of the heavier crudes contain indigenous trace quantities of metals which may be made to perform a catalytic function in the conversion of the hydrocarbons to more valuable products. Such metals include nickel, vanadium, iron, etc. These metals may occur in a variety of forms. They may exist as metal oxides or sulfides introduced into the crude oil as metallic scale or similar particles, or they may exist in the form of water-soluble salts of such metals. Usually, however, they exist in the form of stable organometallic compounds, such as metal porphyrins and the various derivatives thereof.

In addition to organometallic compounds, crude oils contain greater quantities of sulfurous and nitrogenous compounds than are found in lighter hydrocarbon fractions. For example, a heavy Venezuela crude also known as Orinoco Tar, having a gravity of 9.9° API at 60° F., contains about 1260 ppm vanadium, 105 ppm nickel, 11 ppm iron, 5.88 weight percent sulfur and about 0.635 weight percent nitrogen. Reduction in the concentration of the sulfurous and nitrogenous compounds, to the extent that the crude oil is suitable for further processing, is accomplished by conversion to hydrogen sulfide and ammonia.

I have discovered a method to maximize the utilization of hydrogen during the in situ conversion and recovery of heavy hydrocarbonaceous crude oil.

DESCRIPTION OF THE PRIOR ART

A process is disclosed in U.S. Pat. No. 3,084,919 (Slater) for obtaining shale oil from a subterranean oil shale stratum penetrated by a well bore provided with tubing extending from the surface of the earth into the oil shale formation, which comprises supplying liquid hydrocarbon fuel to the bottom of the well bore within the oil shale formation, thereafter supplying air through said tubing into contact with the liquid hydrocarbon fuel in the oil shale formation and initiating combustion therein, withdrawing products of combustion from the oil shale formation through the annular space between the wall of the well bore and the tubing while continuing the supply of air thereto through the tubing effecting heating of the oil shale to a temperature within the range of about 500° F. to 1500° F., discontinuing the introduction of air to the well bore, venting air from the tubing, introducing hydrogen through the tubing to the oil shale formation until a pressure is reached within the range of about 1000 to 5000 psig, permitting the hydrogen to remain in contact with the oil shale formation while maintaining the pressure within the range for a period of at least 6 hours effecting release of shale oil from the oil shale and reaction between the shale oil and hydrogen and withdrawing liberated oil from the well bore. This patent also discloses that a plurality of well bores may be worked wherein one well may be pressured with hydrogen which is recovered from the simultaneous depressuring of another well and which technique is sometimes referred to as a "huff and puff" cycle. This patent relates exclusively to the in situ retorting of oil shale to recover shale oil.

In U.S. Pat. No. 3,139,928 (Broussard), a method is disclosed for processing in situ an oil shale for the purpose of recovering hydrocarbons therefrom wherein a permeable cavern is formed in the shale formation at a point traversed by a well, the method comprising establishing communication between the shale oil-bearing formation and the ground surface through a well normally closed at the top, initially raising the temperature of the walls of the closed well to an elevated temperature promoting partial spontaneous combustion of the exposed formation to release the hydrocarbons from the formation exposed to heat, injecting a quantity of free oxygen-containing gas into the closed well to promote heat generation therein, increasing the pressure within the cavern by injecting another gas which is substantially oxygen free and hydrocarbon free into the closed well to compress the hot gases in the well, maintaining the closed well at these conditions for a time sufficient for heat to pass into previously unheated portions of the shale oil-bearing formation adjacent the well, and subsequently releasing the pressure from the well to produce hydrocarbon-rich heated gas from the well. This patent also teaches the use of a so-called "huff and puff" technique for the in situ processing of oil shale. Although this patent teaches the injection of an oxygen-free and hydrocarbon-free gas to compress other hot gases, the patentee fails to teach any desirability of in situ hydrogenation.

A process is taught in U.S. Pat. No. 4,050,515 (Hamrick et al) for in situ hydrogenation of an underground hydrocarbon formation employing a gas generator in a borehole for burning a hydrogen-rich mixture of hydrogen and oxygen wherein hydrogen and oxygen are supplied downhole to the generator to form a gaseous stream containing hydrogen and steam at a temperature sufficient to crack the hydrocarbons which are recovered from a separate production well. This patent also discloses the use of trace indigenous metals which act as catalysts for hydrocracking. A serious disadvantage of this patent is the incidental presence of the combustion product, steam, which reduces the partial pressure of the hydrogen thereby preventing the maximum hydrogenation of the hydrocarbons.

In U.S. Pat. No. 3,598,182 (Justheim), a method is disclosed for distilling and hydrogenating the hydrocarbon content of carbonaceous materials such as oil shale and tar sand wherein hot hydrogen, undiluted by other gases, is introduced into the carbonaceous material in sufficient quantity and at sufficient temperature to concurrently release and distill the hydrocarbon content.

BRIEF SUMMARY OF THE INVENTION

The present invention is, in one embodiment, a method for the in situ conversion and recovery of heavy hydrocarbonaceous crude oil containing indigenous trace metal from two adjacent non-communicating reservoirs which are alternately pressured and recovered which method comprises: (a) heating the heavy hydrocarbonaceous crude oil in a first reservoir to a hydrocarbon conversion temperature; (b) contacting the first reservoir with elemental, essentially-anhydrous hydrogen at a pressure from about 200 to about 10,000 psig; (c) heating the heavy hydrocarbonaceous crude oil in a second reservoir to a hydrocarbon conversion temperature; (d) depressuring the first reservoir to yield an effluent comprising hydrocarbonaceous crude oil and unreacted elemental hydrogen; (e) separating the effluent from the first reservoir to recover a hydrocarbonaceous crude oil and a gaseous component comprising elemental hydrogen; (f) contacting the second reservoir with elemental, essentially-anhydrous hydrogen, a portion of which is recovered in step (e), at a pressure from about 200 to about 10,000 psig; and (g) depressuring the second reservoir to yield an effluent comprising hydrocarbonaceous crude oil and unreacted elemental hydrogen.

Other embodiments of the present invention encompass further details such as preferred crude oils and operating conditions, all of which are hereinafter disclosed in the following discussion of each of these facets of the invention.

BRIEF DESCRIPTION OF THE DRAWING

The invention will be more completely understood by reference to the accompanying drawing which is a diagrammatic representation of a preferred embodiment of the invention.

The illustration is presented by way of a block-type flow diagram and miscellaneous appurtenances, not believed necessary for a clear understanding of the present invention, have been eliminated from the drawing. The use of details such as pumps, compressors, instrumentation and controls, heat recovery circuits, miscellaneous valving, start-up lines and similar hardware is well within the purview of one skilled in the art. Similarly, with respect to the flow of materials throughout the system, only those major streams required to illustrate the interconnections and interaction of the various zones are presented.

DESCRIPTION OF THE DRAWING AND PREFERRED EMBODIMENT

With reference to the drawing, a hydrocarbon zone 5 is accessed via conduit 4 to establish an in situ reaction zone 6 within the hydrocarbon zone 5. Likewise, an adjacent hydrocarbon zone 9 is accessed via conduit 8 to establish an in situ reaction zone 10 within the hydrocarbon zone 9. In accordance with the present invention, reaction zone 6 does not directly communicate with reaction zone 10.

To initiate the oil recovery process, the in situ reaction zone 6 is heated in any convenient manner to the desired hydrocarbon conversion temperature as hereinafter described. Once reaction zone 6 has attained the desired temperature, an essentially-anhydrous hydrogen stream is originated from hydrogen source 1 and is transported to reaction zone 6 via conduits 2, 3 and 4. Hydrogen is introduced until a suitable hydrocarbon conversion pressure is achieved as described hereinafter. The hydrogen is permitted to remain in contact with the contents of reaction zone 6 for a period from about five minutes to about five days or more. Additional hydrogen is furnished as necessary during this period to maintain the desired pressure. During the reaction period, the heavy petroleum crude oil undergoes hydroconversion. The resulting hydrotreated crude oil has improved characteristics such as lower viscosity and higher hydrogen content than similar untreated crude oil. At some point in time prior to the recovery of hydrotreated crude oil from reaction zone 6, in situ reaction zone 10 is heated to the desired hydrocarbon conversion temperature. When it is deemed appropriate, for whatever reason, the hydroprocessed crude oil which has accumulated in reaction zone 6 may be recovered by discontinuing the flow of hydrogen and permitting the oil to flow from the pressurized reaction zone 6 through conduits 4 and 11 to a suitable gas-liquid separator 12. As the recovery of hydroprocessed crude oil is initiated, an essentially-anhydrous hydrogen stream is transported to reaction zone 10 from hydrogen source 1 via conduits 2 and 8. Meanwhile, a hydrogen-rich gas is separated from hydroprocessed crude oil in gas-liquid separator 12 and recovered via conduit 13. The recovered hydrogen-rich gas is then recycled to supplement the hydrogen supplied to reaction zone 10 which is accomplished by transport of the recovered gas through conduits 13, 2 and 8. The hydroprocessed crude oil is then recovered and withdrawn from gas-liquid separator 12 via conduit 14. Following depressuring of reaction zone 6, this zone is then reheated and pressured with essentially-anhydrous hydrogen to effect further hydroconversion and recovery of oil therefrom. In due course, the hydroprocessed crude oil which has accumulated in reaction zone 10 is recovered by discontinuing the flow of hydrogen and permitting the oil to flow from the pressurized reaction zone 10 through conduits 8 and 11 to gas-liquid separator 12. Once again, a hydrogen-rich gas is separated from hydroprocessed crude oil in gas-liquid separator 12 and recovered via conduit 13. The recovered hydrogen-rich gas is then recycled to reaction zone 6 via conduits 13, 3 and 4. The hydroprocessed crude oil recovered from reaction zone 10 is then withdrawn from gas-liquid separator 12 via conduit 14.

By providing a plurality of reaction zones, some reaction zones may be in the preheat stage while others are in the pressuring, hydroprocessing or depressuring stages. Although only one set of reaction zones is illustrated in the drawing for the purpose of illustration of the process of this invention, it is to be understood that multiple reaction zones may be employed.

DETAILED DESCRIPTION OF THE INVENTION

As hereinabove stated, the present invention principally involves a method for the in situ conversion and recovery of heavy hydrocarbonaceous crude oil containing indigenous trace metal from two or more adjacent hydrocarbon reservoirs which are alternately pressured and recovered which method comprises: (a) heating the heavy hydrocarbonaceous crude oil in a first reservoir to a hydrocarbon conversion temperature; (b) contacting the first reservoir with elemental, essentially-anhydrous hydrogen at a pressure from about 200 to about 10,000 psig; (c) heating the heavy hydrocarbonaceous crude oil in a second reservoir to a hydrocarbon conversion temperature; (d) depressuring the first reservoir to yield an effluent comprising hydrocarbonaceous crude oil and unreacted elemental hydrogen; (e) separating the effluent from the first reservoir to recover a hydrocarbonaceous crude oil and a gaseous component comprising elemental hydrogen; (f) contacting the second reservoir with elemental, essentially-anhydrous hydrogen, a portion of which is recovered in step (e), at a pressure from about 200 to about 10,000 psig; and (g) depressuring the second reservoir to yield an effluent comprising hydrocarbonaceous crude oil and unreacted elemental hydrogen.

I have discovered that greatly improved economy for the recovery of heavy hydrocarbonaceous crude oil is achieved by alternately pressuring and depressuring two recovery areas or wells. After conversion of heavy crude in situ with elevated temperature and hydrogen pressure, the conversion zone and its associated well is depressured into a vessel to provide a gas-liquid separation. This separation provides a liquid stream of hydrocarbonaceous crude oil and a gaseous stream which may contain light hydrocarbons, ammonia, and hydrogen sulfide in addition to elemental hydrogen. At least a portion of the hydrogen recovered from the depressurization in addition to fresh make-up hydrogen is then injected down a second well selected to undergo in situ conversion. In this manner of operation no valuable hydrogen would be lost on the depressuring and hydrocarbon recovery step. Additionally, at least a portion of the light hydrocarbon gases produced and recovered may be utilized as a feedstock for a hydrogen production plant which would supply the hydrogen required for subsequent crude oil conversion reactions. In addition to the benefit of no hydrogen loss, little if any hydrogen storage at the surface is required since the bulk of the hydrogen is stored in the underground formations comprising the hydrocarbon conversion zones and the access thereto.

Preferred heavy hydrocarbonaceous crude oil for use in the instant invention are those crudes which do not readily lend themselves to conventional crude oil recovery; viz., pumping and enhanced oil recovery techniques. Suitable heavy crudes may have a gravity of less than about 20° API at 60° F., a melting point greater than about 100° F., and a trace metal content of greater than about 5 ppm by weight. Trace metal content of from about 5 ppm to about 50,000 ppm is suitable for purposes of the present invention. Trace indigenous metals may include for example nickel, vanadium or iron. Suitable sources of heavy crude are found in such places as the Orinoco Tar Belt deposit in Venezuela, the heavy crudes of California and the Cold Lake deposits in Canada.

Although the conversion of heavy hydrocarbonaceous crudes is enhanced by the presence of catalyst, the in situ conversion of a viscous crude is extremely difficult if not impossible to perform due to the inability to obtain a homogeneous dispersion of catalyst throughout the crude oil to be converted. For this reason, the preferred hydrocarbon crude contains at least trace quantities of metal which are already in place and act as hydrocarbon conversion catalyst or catalyst precursors.

The conversion of heavy hydrocarbonaceous crude oil may be conducted at a temperature from about 400° F. to about 1400° F. and preferably at a temperature from about 500° F. to about 1000° F. After access to the heavy crude deposit is made, the crude is heated to reaction or conversion temperature. Various techniques may be utilized for such heating, such as for example, contact with hot circulating oil, high temperature nitrogen streams, or electrical heating elements. Another heating technique is to inject air into the deposit and ignite a portion of the crude oil to furnish sufficient heat to increase the temperature of the portion of the crude oil which is to undergo hydroconversion. In the event steam is generated during the heating step, any residual steam must be purged from the eventual hydroconversion site in order to maximize the partial pressure of hydrogen in accordance with the process of the present invention.

After the heavy crude oil has been heated to at least about 400° F., elemental essentially-anhydrous hydrogen is introduced to the site of the heated crude oil and the hydroconversion of the crude oil is allowed to proceed. The hydrogen injection stream generally is maintained at a temperature at least above ambient temperature in order to prevent or minimize the cooling of the heavy crude deposit below hydroconversion conditions.

In some cases, it may be advantageous to additionally heat the heavy crude oil deposit in the presence of hydrogen to ensure the desired hydroconversion. The process of hydroconversion is exothermic so that at least a portion of the heat required to maintain sufficient hydrocarbon conversion conditions is inherently produced.

In order to accelerate the rate of reaction for the hydroconversion process and to minimize any coking tendency, the hydroconversion is conducted at a pressure from about 100 to about 10,000 psig and preferably at a pressure from about 200 to about 10,000 psig.

The amount of time required for the hydroconversion of the heavy crude oil depends on the reaction zone temperature, the reaction zone pressure, the concentration of the indigenous trace metal which acts as a catalyst or catalyst precursor, specific characteristics of the crude oil and the degree of conversion desired. Generally, the degree of conversion is sufficient if the volumetric recovery is significantly increased but in some cases, more highly refined crude oil may be desired which requires additional conversion. In any event, the reaction time in contact with hydrogen may suitably occur from a few minutes to several days. It is preferred to perform the in situ hydroconversion for about five minutes to about five days.

Once the desired crude oil conversion is achieved, the reservoir is depressured into a vapor liquid separator to recover a hydrocarbonaceous crude oil and a gaseous component comprising elemental hydrogen. Prior to charging the well effluent comprising hydrocarbonaceous crude oil and hydrogen to the gas-liquid separator, the effluent may be cooled to provide the desired vapor liquid separation. Such cooling may be performed by any convenient means and may include indirect heat exchange of the well effluent stream with water, air, previously recovered hydrocarbon crude oil, previously recovered hydrogen, fresh hydrogen and combinations thereof. The gas liquid separator is preferably maintained at a temperature from about 80° F. to about 400° F. and more preferably from about 100° F. to about 300° F. and preferably at a pressure from about 50 to about 4000 psig. The heavy hydrocarbonaceous crude oil is withdrawn from the gas liquid separator for further processing and use. The vapor phase is withdrawn overhead from the gas liquid separator. The composition of the vapor phase will depend on the temperature and pressure conditions of the separator. Since the hydrocarbon conversion contemplated by the present invention will generate at least a measurable amount of light hydrocarbons such as, for example, methane and ethane, it is preferred that these light hydrocarbons be kept at a relatively low level to permit high concentrations of hydrogen to be present during the hydroconversion. These light hydrocarbons may be eliminated from the conversion system by removing a small slipstream of hydrogen containing light hydrocarbons which slipstream may then be utilized as a source of combustion fuel or a feed stock to a hydrogen production plant. Other methods to eliminate light hydrocarbons may include periodic blowdown or cryogenic treatment of the hydrogen streams.

The pressure and temperature of the recovered vapor phase may be further adjusted to increase the concentration of hydrogen. Any light hydrocarbons which are recovered from such a hydrogen concentration step may favorably be utilized as a feedstock for a hydrogen plant which in turn would be used as make-up hydrogen for further heavy hydrocarbonaceous crude oil conversion and recovery.

The resulting gaseous component comprising a high percentage of essentially-anhydrous hydrogen is compressed to a pressure high enough to establish a gaseous flow into the next heated reservoir of heavy hydrocarbonaceous crude oil. Since the process of the present invention chemically consumes hydrogen during hydroconversion, additional make-up hydrogen must also be supplied at a sufficiently high pressure to cause hydrogen to flow to the reservoir.

The pressure of the combined hydrogen sources is preferably from about 100 to about 15,000 psig and more preferably from about 200 to about 10,000 psig. It is also preferable that the injected hydrogen temperature is from about 100° F. to about 800° F. and more preferably from about 200° F. to about 700° F. Prior to injection, the hydrogen may be heated by any convenient method known in the prior art. Such heating may be performed by compression, indirect heat exchange with water, air, steam, previously extracted well effluent, previously recovered hydrocarbon crude oil, previously recovered hydrogen or combinations thereof.

Once the desired crude oil conversion is achieved, the reservoir is depressured into a gas liquid separator to recover a hydrocarbonaceous crude oil and a gaseous component comprising elemental hydrogen as hereinabove described.

The present invention, in contradistinction with U.S. Pat. No. 3,084,919 (Slater) and U.S. Pat. No. 3,139,928 (Broussard) relates to a method for the in situ hydroconversion and recovery of heavy hydrocarbonaceous crude oil. In addition, it is believed that neither of these hereinabove mentioned and described patents teaches or suggests that any of their techniques, details or disclosures are applicable to the hydroconversion and recovery of hydrocarbonaceous crude oils which are indigenous to underground formations which are totally unlike those containing oil shale and/or tar sand. Oil shale or tar sand deposits are generally considered to be solid deposits with a minimum, if any, of void spaces contained within these deposits which make them amenable to the processes taught by Slater and Broussard in that, because of the impervious nature of the deposits, the reaction zone may be contained. Traditional deposits of readily recoverable crude oil, however, are found, for example, in porous sand, interspersed within separated rock strata and entrapped under domes of rock. Such oil deposits because of their porosity and inherent inability to contain an in situ reaction zone, have not been considered by the art to be candidates for underground conversion processes. I have discovered however that the extremely heavy crude oil deposits as hereindescribed may be successfully subjected to in situ hydroconversion. It appears that the very heaviest constituents of the heavy crude oil serve to seal off the reaction zone and, in particular, allow the buildup of the necessary hydrogen pressure. This surprising and unexpected result has not been suggested or disclosed by the prior art including U.S. Pat. Nos. 3,084,919 and 3,139,928.

As discussed hereinbefore, U.S. Pat. No. 4,050,515 (Hamrick) is distinguished from the present invention in that in Hamrick steam is mixed with the hydrogen in contact with the oil. Furthermore, it is believed that the Hamrick patent does not disclose the novel process of the present invention nor does it teach or suggest a combination of the prior art to achieve the advantages associated with my invention as described herein.

Although U.S. Pat. No. 3,598,182 (Justheim) teaches the in situ treatment of hydrocarbonaceous materials with pure hot hydrogen, the present invention is distinguished in that the economical recovery and recycle of hydrogen is not disclosed by patentee Justheim and it is furthermore believed that the patentee does not teach or suggest the combination of the prior art to obtain the economy of my process as herein described.

The following illustrations are given to illustrate further the method for the in situ conversion and recovery of heavy hydrocarbonaceous crude oil containing indigenous trace metal. Specific operating conditions, processing techniques, particular crude oil and product characteristics and other individual process details will be given for illustrative purposes in the following detailed description, and it is not intended that the invention be limited to these specific illustrations, nor the particular operating conditions, processing techniques, crude oil, etc. The following data were not obtained by the actual performance of the present invention, but are considered prospective and reasonably illustrative of the expected performance of the invention.

ILLUSTRATION I

Conventional well drilling techniques are utilized to gain access to a deposit of Orinoco Tar having the characteristics presented in Table I and approximately 5 volume percent of the deposit is recovered. No further recovery is deemed feasible utilizing conventional petroleum recovery techniques.

TABLE I

| ORINOCO TAR INSPECTION | |
|---|---|
| Gravity, °API at 60° F. | 9.9 |
| Sulfur, wt. % | 5.88 |
| Nitrogen, wt. % | 0.635 |
| Heptane Insoluble, wt. % | 12.7 |
| Metals, ppm | |
| Iron | 11 |
| Nickel | 105 |
| Vanadium | 1260 |

TABLE I-continued

| ORINOCO TAR INSPECTION | |
|---|---|
| Distillation | |
| IBP, °F. | 187 |
| 10% | 572 |
| 30% | 840 |
| 43% | 1000 |

ILLUSTRATION II

The drilling and recovery site of Illustration I is selected to demonstrate a preferred embodiment of the present invention. Another well is drilled approximately 2000 feet from the first drilling site and approximately 5 volume percent of the available crude oil or tar deposit is recovered. As was the case in the first well, no further recovery is deemed feasible from the second well. A fire flood is started in the first tar deposit by injecting air and a source of ignition. A portion of the tar deposit is consumed by fire to furnish enough heat to raise the surrounding tar to a temperature of about 850° F. When the desired ambient tar temperature is reached, in this case 850° F., the air supply is discontinued in order to extinguish the fire and any residual steam is purged from the combustion site. Then the hot tar deposit is pressured with hot hydrogen at a temperature of about 500° F. and a pressure of about 1500 psig and is permitted to remain at hydroconversion conditions for 48 hours. During the conversion period, the consumed hydrogen is replenished to maintain the desired reaction pressure. After the hydroconversion is performed, the tar deposit or reservoir is depressured and the resulting effluent comprising hydrocarbonaceous crude oil and unreacted elemental hydrogen is indirectly heat exchanged to reduce the temperature of the effluent to about 350° F. This effluent is separated in a gas liquid separator at a temperature of about 350° F. and a pressure of about 400 psig to yield an additional 15 volume percent of the tar deposit which has the characteristics presented in Table II and a vaporous stream containing approximately 75 percent hydrogen and about 25 percent light normally gaseous hydrocarbons such as methane, ethane, propane and butane.

TABLE II

| CONVERTED ORINOCO TAR INSPECTION | |
|---|---|
| Gravity, °API at 60° F. | 14.0 |
| Sulfur, wt. % | 5.0 |
| Nitrogen, wt. % | 0.6 |
| Heptane Insoluble, wt. % | 11.0 |
| Metals, ppm | |
| Iron | 10 |
| Nickel | 100 |
| Vanadium | 1200 |
| Distillation | |
| IBP, °F. | 170 |
| 10% | 550 |
| 30% | 820 |
| 50% | 1000 |

The hydrogen concentration of this vaporous stream may be optionally increased by the removal of hydrocarbons. But for purposes of the present example, the whole vaporous stream containing a relatively high concentration of hydrogen and a stream of make-up hydrogen are compressed to a pressure of about 2500 psig and then, via indirect heat exchange, are heated to a temperature of about 500° F. The resulting hot, high pressure hydrogen is injected into the second tar deposit which has been previously heated to about 850° F. as hereinabove described for the first tar deposit. During the hydroconversion lasting 48 hours, the consumed hydrogen is replenished to maintain the pressure of the hydroconversion zone at about 1500 psig. After the hydroconversion is performed, the tar deposit or reservoir is depressured and the resulting effluent comprising hydrocarbonaceous crude oil and unreacted elemental hydrogen is recovered in the manner hereinabove described. An additional 15 volume percent of the tar deposit is recovered which also has the characteristics presented hereinabove in Table II. The recovered vaporous stream is subsequently utilized for the in situ conversion and recovery of heavy hydrocarbonaceous crude oil.

The foregoing specification and illustrations clearly demonstrate the improvement encompassed by the present invention and the benefits to be afforded therefrom.

I claim:

1. A method for the in situ conversion and recovery of heavy hydrocarbonaceous crude oil containing indigenous trace metal from two adjacent non-communicating reservoirs containing said crude oil and which are alternately pressured and recovered, which method comprises:

(a) establishing within a first of said crude oil reservoirs an in situ reaction zone and heating the crude oil therein to a hydrocarbon conversion temperature;

(b) thereafter introducing to said reaction zone sufficient elemental, essentially-anhydrous hydrogen to generate therein a pressure from about 200 to about 10,000 psig and contacting the oil in said zone with the hydrogen for a sufficient time to effect hydroconversion therein;

(c) establishing within the second of said crude oil reservoirs a second in situ reaction zone and heating the crude oil therein to a hydrocarbon conversion temperature;

(d) depressuring said first reaction zone to yield an effluent comprising hydroprocessed crude oil and unreacted elemental hydrogen;

(e) separating the effluent from said first reaction zone to recover a hydroprocessed crude oil and a gaseous component comprising elemental hydrogen;

(f) introducing to said second reaction zone sufficient elemental, essentially-anhydrous hydrogen, a portion of which is recovered in step (e), to generate therein a pressure from about 200 to about 10,000 psig and effecting hydroconversion of crude oil in the second reaction zone; and, (g) depressuring said second reaction zone to yield an effluent comprising hydroprocessed crude oil and unreacted elemental hydrogen.

2. The method of claim 1 wherein said hydrocarbon conversion temperature includes a temperature from about 500° F. to about 1000° F.

3. The method of claim 1 wherein said indigenous trace metal includes nickel, vanadium and iron.

4. The method of claim 1 wherein said conversion is performed for about five minutes to about five days.

5. The method of claim 1 wherein said indigenous trace metal is present in an amount from about 5 ppm to about 50,000 ppm.

6. The method of claim 1 wherein said hydrocarbonaceous crude oil is a heavy California crude oil, an Orinoco Tar or a Cold Lake crude oil.

7. The method of claim 1 wherein said separating step (e) is conducted at conditions including a temperature from about 100° F. to about 300° F. and a pressure from about 50 psig to about 4000 psig.

* * * * *